United States Patent [19]

Merlet

[11] Patent Number: 4,578,300

[45] Date of Patent: Mar. 25, 1986

[54] LAYER FOR FIXING MOQUETTES, CARPETS, RUGS OR THE LIKE

[76] Inventor: Brigitte I. Merlet, 14, avenue Dubonnet, Courbevoie (Hauts de Seine), France

[21] Appl. No.: 771,480

[22] Filed: Sep. 3, 1985

Related U.S. Application Data

[63] Continuation-in-part of Ser. No. 622,137, Jun. 19, 1984, abandoned.

[30] Foreign Application Priority Data

Jun. 22, 1983 [FR] France ..... 83 10334

[51] Int. Cl.[4] ..... B32B 5/06

[52] U.S. Cl. ..... 428/91; 428/96; 428/300; 428/301; 428/354

[58] Field of Search ..... 428/91, 86, 96, 95, 428/300, 301, 354

[56] References Cited

U.S. PATENT DOCUMENTS 3,937,861 2/1976 Zuckerman et al. ..... 428/300

*Primary Examiner*—Marion C. McCamish

*Attorney, Agent, or Firm*—Mason, Kolehmainen, Rathburn & Wyss

[57] ABSTRACT

This invention concerns a layer for fixing moquette, carpets, rugs or the like, characterized in that it is composed of a lower layer of needled fibres and a separating band traversed by a proportion of the fibres of the lower layer, the lower layer of fibres being equipped with an anti-slip layer, the upper layer, formed by the proportion of fibres which have traversed the separating band, being coated with permanent glue.

3 Claims, 4 Drawing Figures

LAYER FOR FIXING MOQUETTES, CARPETS, RUGS OR THE LIKE

This application is a continuation-in-part, of application Ser. No. 622,137 filed June 19, 1984 now abandoned.

The present invention relates to a layer for fixing moquettes, carpets or the like.

Various processes for attaching moquettes or similar products are known. One traditional process consists of fixing a strip studded with nails to an anchoring strip on the reverse side along the walls of the room and then hooking the moquette under tension into these nails. Such a method of fixing has considerable advantages from the point of view of comfort but cannot be used for woven moquettes manufactured in the traditional manner.

Other types of moquettes, in particular so-called tufted moquettes cannot be fixed by this method because most of them have a backing of natural foam rubber. Then again, there are so-called needled moquettes, with or without backing. Such a moquette can only be fixed by glueing. The glue may be applied either over the whole surface of the room or only by means of double-sided strips of adhesive attached along the wall. The method of glueing over the whole or almost the whole surface of the room has various disadvantages, in particular a reduction in the suppleness of the moquette and consequently a loss in comfort. Moreover, this method of fixing is liable to damage the underlying support, such as the parquet flooring or other floor surface when the moquette is required to be removed or replaced.

The method of glueing the moquette down at the periphery of the room does not have this disadvantage but due to the deformations which such a moquette undergoes in use, bulges and unsightly deformations rapidly appear.

In short, none of the known solutions for fixing a tufted or needled moquette is really satisfactory.

It is an object of the present invention to provide simple means by which a moquette, in particular of the tufted or needled type may readily be fixed without the risk of any bulges or deformations appearing and without any loss in comfort. On the contrary, the standard of comfort is improved and at the same time the moquette is fitted more easily and can rapidly be removed without damage to the supports (parquet or other floor surface).

The invention also relates to a layer for fixing moquette, carpets or the like, characterised in that it is composed of a lower layer of needled fibres, a separating band through which a portion of the fibres of the lower layer extend, the lower layer of fibres being treated with an anti-slip agent, for example by spraying them with an anti-slip product, and an upper layer formed by the portion of fibres which have passed through the separating band, this upper layer being coated with permanent adhesive.

In this layer, the fibres are in particular of a synthetic material while the separating band is a plastics material.

The fixing layer is interesting both from the point of view of manufacture and from that of practical use. Manufacture of the layer is particularly simple since no particular precautions are required for glueing: The upper layer is treated with glue without this glue being able to reach the lower layer, which is therefore not tacky. It is therefore only necessary to cover this one sticky surface with a layer of anti-stick material to enable the layer to be rolled up.

The product obtained by this process is particularly stable since the separating band is very firmly caught between the two layers 1 due to the fact that part of the fibres of the lower layer pass through the separating band to form the upper layer. The glue applied to the upper layer attaches this layer to the back of the moquette, carpet or the like without reaching the lower layer. The upper and lower layer constitute a single part since they consist of the same fibres and are therefore firmly attached together.

Furthermore, the fixing layer not only attaches the moquette to the ground but also reinforces it by forming bonds in all directions in its place. This results in excellent stability enabling the moquette to resist not only displacement but also deformation. The moquette is held in position and will not undergo deformation to form bulging areas.

As regards practical use, positioning of the fixing layer and positioning of the moquette are very simple operations requiring no particular tools or skill. Since the glue cannot penetrate to the lower layer, this layer cannot become matted or stick to the ground and it therefore preserves its suppleness and enables the moquette to be readily removed, for example for repair or cleaning, for changing or for painting and decorating work.

The fixing layer may also be used for laying "extra width" woven moquettes or tufted moquettes with simple or double backing of jute or synthetic material, in which case it eliminates the need for anchoring strips which entail much work and cost.

The present invention will be described in more detail below with reference to the attached drawings, in which FIG. 1 is a schematic view of the layers of an adhesive felt according to the prior art;

FIG. 2 shows schematically the first phase of manufacture;

FIG. 3 shows schematically the second phase of manufacture; and

FIG. 4 represents schematically the end product obtained.

Figure 1:
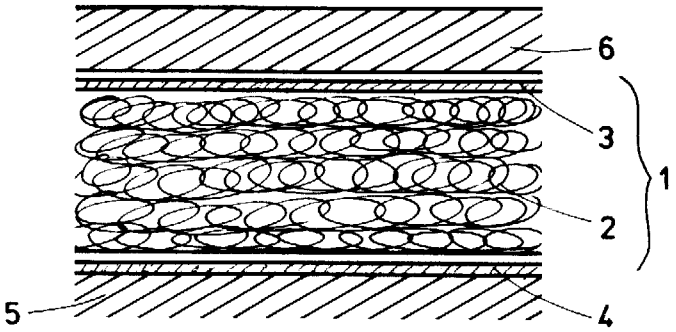

FIG. 1 shows a known layer of felt 1 comprising an intermediate layer of needled felt 2 whose upper and lower surfaces 3,4, respectively, have been treated with a layer of glue such as acrylic ester copolymers emulsionated in water. The layer 4 is provided for fixing the layer 1 to the ground 5 while layer 3 is applied to the back of the moquette 6 before fixing it. The moquette 6 is thereby attached to the ground 5.

This solution appears to be quite satisfactory but in practice the layer 1 gets crushed and layers of glue 3, 4 then penetrate the layer of fibres 2, causing this layer 2 to harden.

After a relatively short time in use, layer 1 has lost its elasticity and suppleness and only a relatively hard layer remains.

The process of manufacturing a fixing layer according to the invention is described below with reference to FIGS. 2, 3 and 4. During the process employed for manufacturing such a layer for fixing moquette, the fixing layer is reversed in relation to its position when in use.

Figure 2:
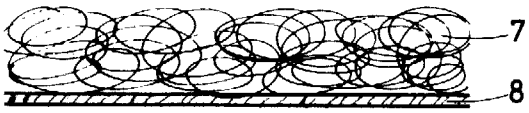
FIGS. 2, 3 and 4 show schematically the three stages in the manufacture of a fixing layer according to the invention.
Figure 3:
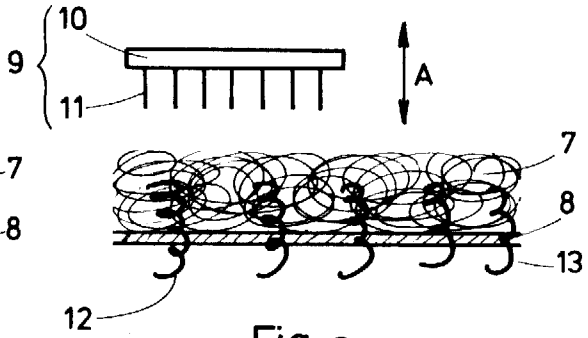

According to FIG. 2, showing the first phase in the manufacture of fixing layer, a layer of polyester fibres 7 in the pre-needled state is deposited on a polyethylene separating band 8 made, for example, of a flexible plastics material the characteristics of which are compatible with the constituents of the whole product to be obtained.

The fibres 7 may be of natural or artificial origin or they may be of synethetic origin to avoid any risk of putrefaction.

Once the layer has been placed in position, with the fibres 7 preferably in the pre-needled state, that is to say, overlapping one another so that they can intermesh and take up swelling agent, the whole arrangement is passed through a needling machine by which the product becomes tufted. This machine is indicated schematically by a tool 9 consisting of a plate 10 carrying spikes 11. This tool 9 moves vertically up and down through layer 7 in the direction indicated by the double arrow A and passes through the separating band 8 so that some of the fibres 12 are carried through the separating band 8 to appear on the other side.

As already mentioned above, layer 7 constitutes the lower layer and layer 13 formed by a proportion of the fibres 12 constitutes the upper layer since the position during manufacture of the fixing layer (FIG. 3) is the reverse of its position in use.

Figure 4:
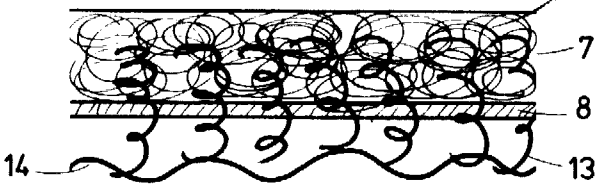

FIG. 4 shows the form of the fixing layer for the moquette after it has been sprayed with an anti-slip agent and glue.

This fixing layer is in all cases represented in the reversed position used in FIG. 4.

In this figure, the upper layer 13 is covered with a film of glue 14, and a film 15 of anti-slip material is then applied to the lower layer 7. The film of permanent glue or adhesive 14 on the upper layer 13 is applied according to the use to which the layer according to the invention is to be put.

Since the fixing layer is handled, stored and transported in the form of a roll, it is advantageous to apply a protective film at least to the layer 14 to prevent the layer 14 from drying up and ensure that it does not stick to the film 15 when it is rolled up.

The product obtained by the process described above is thus distinguished in that it is composed of a lower layer 7 of needled fibres and a separating band 8 through which a proportion 13 of the fibres extend. The lower layer 7 is equipped with an anti-slip coating 15. The upper layer 13 formed by the fibres which have passed through the separating film 8 is coated with a layer of permanent glue 14. This layer of glue is subsequently to be applied to the back of the moquette.

Since the lower layer 7 carries an anti-slip layer 15, there is no risk of sliding.

It should be noted that the separating band 8 is an excellent insulating agent, in particular to prevent glue passing from layer 13 to layer 7, and hence preventing any loss in suppleness of the fixing layer.

In addition to the advantages already indicated above, it should be noted that the fixing layer according to the invention enables a moquette or the like to be placed directly on a bare floor surface such as a smooth concrete surface without requiring any preliminary treatment.

The fixing layer also substantially increases the life of the backing of natural or synthetic foam rubber since the adhesive surface carrying the plastics film is in direct contact with the rubber backing and insulates it, thereby preventing air from rapidly disintegrating the foam rubber backing as it did in the conventional method of laying these floor coverings.

I claim:

1. Layer for fixing moquette, carpets, rugs or the like, characterised in that it is composed of a lower layer of needled fibres and a separating band transversed by a proportion of the fibres of the lower layer, the lower layer of fibres being equipped with an anti-slip layer, the upper layer, formed by the proportion of fibres which have traversed the separating band, being coated with permanent glue.

2. Layer according to claim 1, characterised in that the fibres are of a synthetic material.

3. Layer according to claim 1, characterised in that the separating band is a flim of synthetic material.

* * * * *